United States Patent [19]

Bellows

[11] Patent Number: 4,464,641

[45] Date of Patent: Aug. 7, 1984

[54] CIRCUIT BREAKERS

[75] Inventor: Alfred H. Bellows, Wayland, Mass.

[73] Assignee: GTE Laboratories Incorporated, Waltham, Mass.

[21] Appl. No.: 450,486

[22] Filed: Dec. 16, 1982

[51] Int. Cl.[3] ..... H01H 75/12

[52] U.S. Cl. ..... 335/23; 335/37; 337/54

[58] Field of Search ..... 335/23, 35, 37, 42, 335/45; 337/54, 90, 75

[56] References Cited

U.S. PATENT DOCUMENTS 2,732,455 1/1956 Ericson et al. ..... 335/37

3,566,318 2/1971 Gelzheiser et al. ..... 335/23

*Primary Examiner*—Joseph W. Hartary

*Assistant Examiner*—George Andrews

*Attorney, Agent, or Firm*—David M. Keay

[57] ABSTRACT

A circuit breaker having an overload mechanism including an elongated bimetallic element having one end pivotally mounted in the circuit breaker housing and the other end pivotally positioned at one end of an armature element. The armature element has a latching surface engaging a trip arm to hold it in a set position. An overload current causes the bimetallic element to bend. Since the ends of the bimetallic element are constrained, its central portion moves causing the armature element to pivot disengaging its latching surface from the trip arm. The released trip arm pivots to a tripped position causing the breaker contacts to be opened.

12 Claims, 3 Drawing Figures

CIRCUIT BREAKERS

BACKGROUND OF THE INVENTION

This invention relates to circuit breakers. More particularly, it is concerned with low voltage circuit breakers for controlling low and moderate power electrical circuits.

A circuit breaker for use in controlling electrical circuits typically has a set of contacts, one fixed and one movable, and a toggle, or overcenter mechanism, which is manually operated to close and open the contacts. A circuit breaker also includes an overload mechanism for tripping the circuit breaker and opening the contacts automatically when the electrical current through the circuit breaker exceeds certain predetermined conditions.

Typically circuit breakers of this type include an overcenter spring which is connected between a movable contact arm carrying the movable contact and a trip arm which is held latched in a set position under normal operating conditions. The contact arm pivots about a pivot point which is shiftable by means of a manually operated handle to place the pivot point on one side of the overcenter spring whereby the spring causes the contacts to be closed, or to place the pivot point on the other side of the overcenter spring whereby the spring causes the contacts to be open. Under overload conditions a current sensitive mechanism releases the latched trip arm and the overcenter spring moves the trip arm from the set to a tripped position. Movement of the trip arm to the tripped position shifts the position of the overcenter spring with respect to the pivot point and the force of the overcenter spring in this position causes the contacts to open.

Typically the overload mechanism includes a bimetallic element which has one end fixed with respect to the circuit breaker housing. The other end of the bimetallic element engages the trip arm but is free with respect to the housing. Under overload conditions the bimetallic element deflects and the free end moves to release the trip arm which moves from the set to the tripped position thereby opening the contacts. Under very high current conditions, such as during a short circuit, the bimetallic element heats rapidly and deflects almost instantaneously to release the trip arm.

Under overload conditions of relatively small magnitude, however, the bimetallic element is designed to deflect slowly so that the overload mechanism trips only after a substantial time interval which is related to the overload current. Small variations in the dimensions of the breaker components can result in a significant effect on the reaction time of the overload mechanism. These variations may be due to such factors as differences in coefficients of thermal expansion, wear over the life of the breaker, or external mechanical stresses.

SUMMARY OF THE INVENTION

An improved circuit breaker in accordance with the present invention comprises a housing of insulating material. A fixed contact is mounted in the housing and a movable contact is mounted on a contact carrier. An operating means manually moves the contact carrier to selectively move the movable contact between a closed position and an open position with respect to the fixed contact. A trip arm is pivotally mounted in the housing so as to be movable from a set position to a tripped position. The circuit breaker includes a load terminal and a thermally responsive latching member connected in the circuit between the load terminal and the movable contact. One end of the thermally responsive latching member is pivotally mounted in the housing. Biasing means bears against the other end of the thermally responsive latching member and urges it toward the trip arm. The thermally responsive latching member has a latching surface intermediate its ends which engages the trip arm and maintains the trip arm in the set position. The thermally responsive latching member bends in response to a predetermined current condition to move the latching surface intermediate its ends and disengage the latching surface from the trip arm releasing the trip arm for movement to the tripped position. Movement of the trip arm to the tripped position causes the contacts to open.

Figure 2:
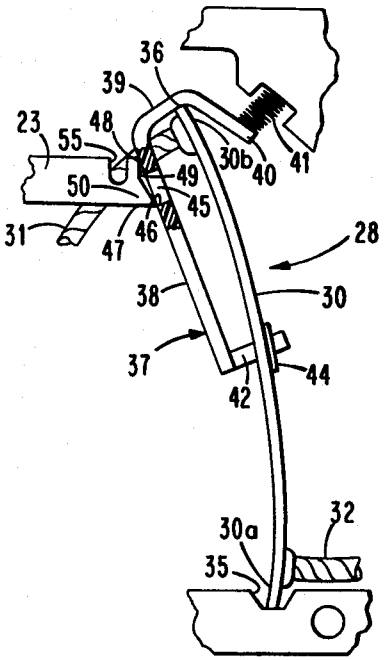
FIG. 2 is a side elevational view of a fragment of the circuit breaker of FIG. 1 showing the overload mechanism at the instant of tripping.

For a better understanding of the present invention together with other and further objects, advantages, and capabilities thereof, reference is made to the following discussion and appended claims in connection with the above described drawings.

DETAILED DESCRIPTION OF THE INVENTION

A circuit breaker in accordance with the present invention as illustrated in the figures includes a housing comprising a case 10 of a suitable insulating material and a cover (not shown) of similar material. The case and cover are typically of molded plastic. The various elements of the circuit breaker mechanism are mounted within the case 10 and held in place by the cover which is riveted to the case.

A fixed contact 13 is mounted on a line terminal 14 which is designed to engage a line bus when the breaker is inserted into a distribution panel box. A moving contact 15 is mounted on a contact carrier 16. A handle 17 of insulating material is pivotally mounted within the case 10 in a conventional manner for manual operation.

Figure 1:
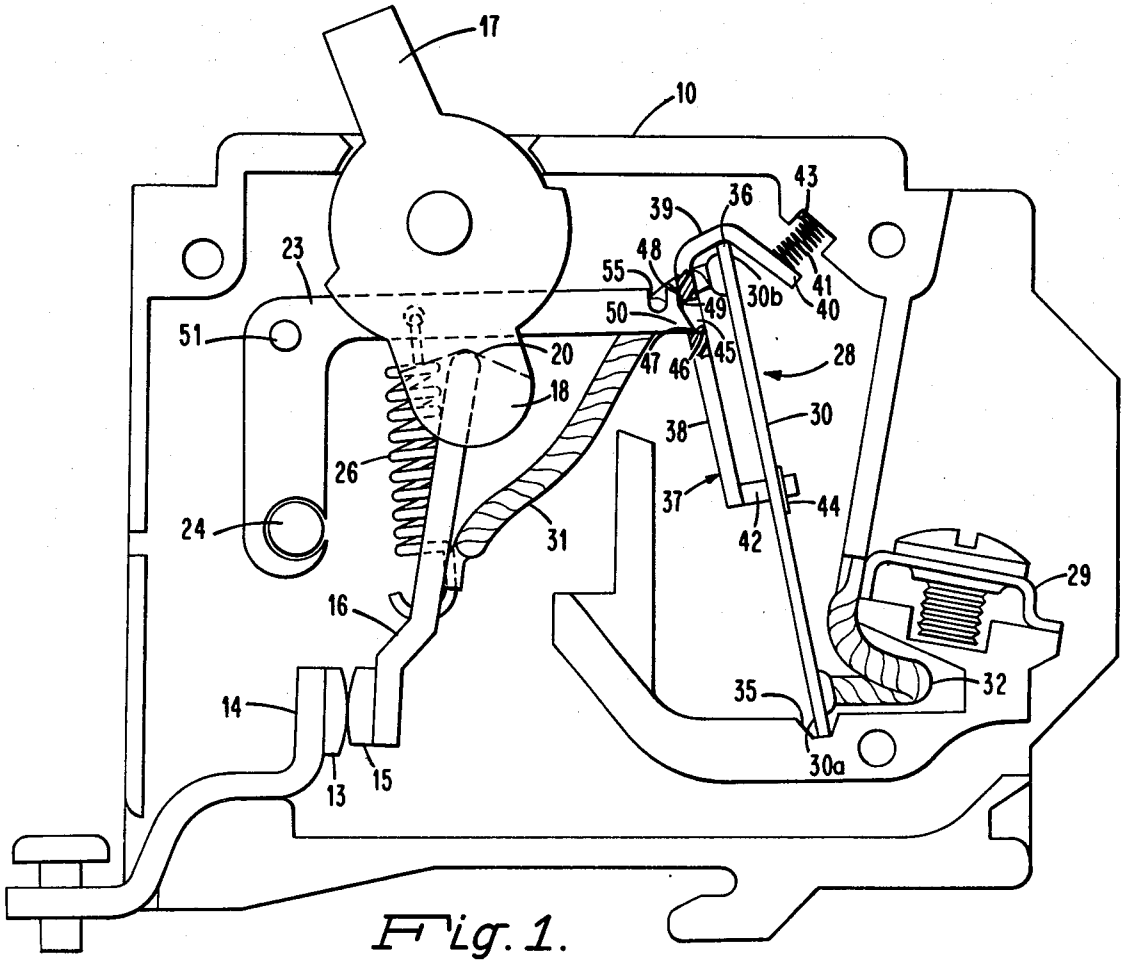
FIG. 1 is a side elevational view of a circuit breaker in accordance with the present invention with the cover of the housing removed and showing the contacts in the closed position.
Figure 3:
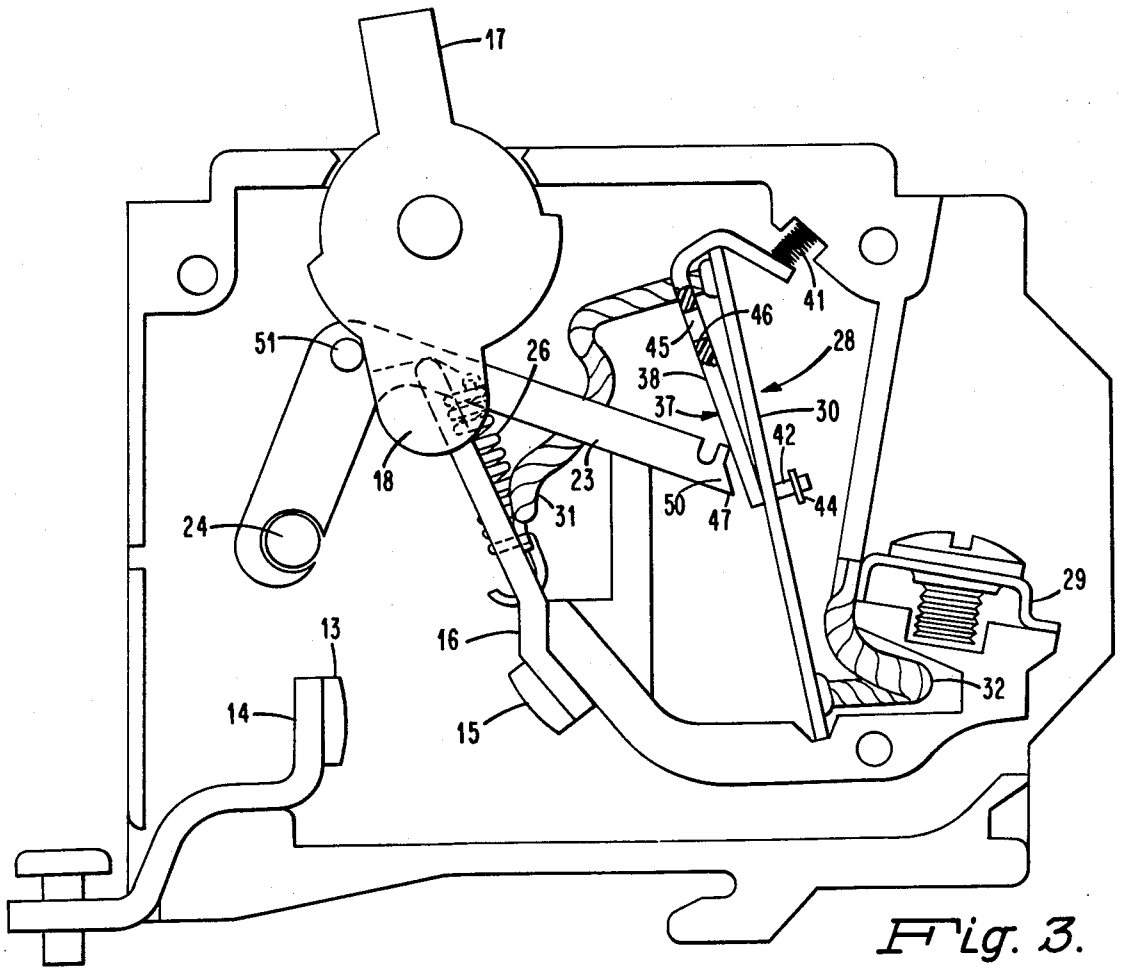
FIG. 3 is a side elevational view of the circuit breaker of FIG. 1 with the cover of the housing removed and showing the contacts in the tripped position.

The end of the contact carrier 16 is positioned in slots in two arms 18 extending from the handle 17 so as to provide a pivot point of connection 20 between the contact carrier 16 and the handle 17. A trip arm 23 is mounted on a boss 24 in the case 10 for pivoting between a set position as shown in FIG. 1 and a tripped position as shown in FIG. 3. An overcenter tension spring 26 has one end connected to the contact carrier 16 and the other end connected to the trip arm 23. The handle 17, contact carrier 16, and spring 26 form an overcenter arrangement, or toggle, which urges the movable contact 15 toward the fixed contact 13 when the spring 26 is on one side of the pivot point 20 as shown in FIG. 1, and urges the movable contact 15 to the open position when the spring 26 is on the other side of the pivot point 20.

A load terminal 29 for connecting the circuit breaker to a load circuit is positioned in the molded case 10. The circuit breaker also contains an overload mechanism including a thermally responsive latching member 28. The thermally responsive latching member 28 includes a thermally responsive element 30 which is a generally flat elongated bimetallic or thermostat element connected in series between the movable contact 15 and the load terminal 29 by flexible conductors 31 and 32, respectively. Flexible conductor 31 is connected between the contact carrier 16 and the upper end 30*b*, as shown in the figures, of the bimetallic element 30, and flexible conductor 32 is connected between the lower end 30*a* of the bimetallic element 30 and the load terminal 29. The lower end 30*a* of the bimetallic element 30 is positioned in a recess 35 in the case 10 in a manner to permit limited pivotal movement when the bimetallic element 30 bends or flexes.

The thermally responsive latching member 28 also includes a rigid generally J-shaped armature element 37 of a magnetic material. The armature element 37 has a first arm 38 which lies generally parallel to the bimetallic element 30. A second arm 39 contiguous with the upper end of the first arm 38 has a configuration which forms a bend 36. The bend receives and positions the upper end 30*b* of the bimetallic element 30 so as to constrain it while providing a pivot point therefor. A compression spring 41 having one end positioned in a recess 43 in the case 10 bears against a portion 40 of the second arm 39. A hook portion 42 at the lower end of the first arm 38 of the armature element 37 entraps the central portion of the bimetallic element 30 while permitting limited motion therebetween. Insulation 44 attached to the hook portion 42 prevents electrical contact between the central portion of the bimetallic element 30 and the hook portion 42 so that the armature element does not by-pass any current around the upper portion of the bimetallic element.

The first arm 38 of the armature element 37 has an aperture 45 therethrough providing a lower edge 46 which serves as a latching surface for engaging the trip arm 23. The surface of the first arm 38 above the aperture 45 provides a bearing surface 48 which is in contact with the trip arm 23. The end of the trip arm 23 terminates in a projection 50 which extends into the aperture 45 with the lower edge surface of the projection 50 providing a latching surface 47 which is generally normal to the first arm 38 of the armature element and engages the latching surface 46 of the armature element. The edge of the trip arm 23 above the projection 50 provides a bearing surface 49 which is in contact with the bearing surface 48 of the armature element.

The bimetallic element 30 is held by its opposite ends 30*a* and 30*b* in the recess 35 and in the bend 36 in the second arm 39 of the armature element 37. The compression spring 41 biases the armature element 37 in a clockwise direction, as shown in the figures, urging the hook portion 42 against the central portion of the bimetallic element 30 and urging the bearing surface 48 of the armature element against the bearing surface 49 of the trip arm 23. The compression spring 41 also urges the lower end 30*a* of the bimetallic element 30 into the recess 35. The projection 50 of the trip arm 23 extends into the aperture 45 and the action of the overcenter tension spring 26 on the trip arm 23 urges the latching surface 47 of the trip arm 23 against the latching surface 46 at the edge of the aperture 45 in the armature element. Under these condition the trip arm 23 is in the set position and manual operation of the handle 17 selectively opens or closes the contacts.

FIG. 2 illustrates the overload mechanism at the point of tripping due to an overload current. The bimetallic element 30 bends or deflects because of the heat generated therein by the current flow therethrough. Since the opposite ends 30*b* and 30*a* of the bimetallic element 30 are confined in the recess 35 and in the bend 36, the central portion moves toward the right, as seen in FIGS. 1 and 2. Movement of the central portion of the bimetallic element 30 moves the hook portion 42 causing the armature element 37 to pivot in a counterclockwise direction. The compression spring 41 continues to urge the bearing surface 48 of the armature element against the bearing surface 49 of the trip arm 23. Thus the projection 50 at the end of the trip arm 23 remains within the aperture 45 with the latching surface 47 of the trip arm in contact with the latching surface 46 of the armature element.

When the deflection of the bimetallic element 30 rotates the armature element 37 through a sufficient angle about the point of engagement of the bearing surfaces 48 and 49, the latching surface 46 of the armature element 37 clears the latching surface 47 of the trip arm 23. FIG. 2 illustrates the mechanism at this instant in the tripping action. When the latching surface 46 disengages from the latching surface 47, the overcenter spring 26 causes the trip arm 23 to pivot in a clockwise direction about the pivot point 24 to the tripped position as shown in FIG. 3. As the trip arm 23 rotates to the tripped position, the line of action of the overcenter spring 26 is shifted to the opposite side of the pivot point 20 of the handle 17 and the contact carrier 16. The overcenter spring 26 causes the contact carrier 16 to pivot in a counterclockwise direction separating the movable contact 15 from the fixed contact 13. The circuit breaker is thus tripped with the elements in the positions as shown in FIG. 3.

The mechanism operates in the typical well-known manner to reset the circuit breaker after the overload condition has been cleared. The circuit breaker is manually reset by rotating the handle 17 to the open or extreme clockwise position. During this movement an arm 18 of the handle 17 engages a pin 51 on the trip arm 23 rotating the trip arm in the counterclockwise direction about the pivot point 24. During this rotation the end of the trip arm 23 slides along the surface of the first arm 38 of the armature element forcing the armature element in a counterclockwise direction against the urging of the compression spring 41. When the projection 50 reaches the aperture 45 in the first arm of the armature element 37, the spring 41 biases the armature element into position so that the latching surfaces 46 and 47 are in engagement holding the trip arm 23 in the set position. During the resetting procedure the contact carrier 16 is restored to the normal open position. The contacts may then be closed by rotating the handle 17 manually in the counterclockwise direction in accordance with normal operation.

The circuit breaker as shown may respond to large overload currents such as under shortcircuit conditions to trip without any delay. Heavy current flow in the bimetallic element 30 produces a magnetic field which attracts the magnetic armature element 37. The armature element 37 pivots in a counterclockwise direction about the pivot point 36. The amount of angular movement permitted before the lower end of the first arm 38 of the armature element strikes the central portion of the bimetallic element 30 is sufficient to withdraw the latching surface 46 of the armature element from the latching surface 47 of the trip arm 23 causing tripping of the mechanism in the manner previously described. This action can be augmented if desired by the addition of a suitable pole piece mounted on or around the bimetallic element.

In the circuit breaker as shown the bearing surfaces 48 and 49 provide a reference point for establishing the extent of engagement of the latching surfaces 46 and 47. During assembly of the breaker the amount of overlap of the latching surfaces 46 and 47, and hence the current required for tripping, can be adjusted by shifting the point of contact of the bearing surfaces 48 and 49 to the right or left. As illustrated in the figures a notch 55 may be provided in the trip arm 23 adjacent to the end to facilitate deforming the end of the trip arm sufficiently to shift the location of the bearing surface 49.

In the circuit breaker as shown the point of tripping is determined by the curvature of the bimetallic element 30 which translates to a critical angle of the armature element 37 which, in turn, is established by the bearing surfaces 48 and 49 and the latching surfaces 46 and 47. Although various elements within the circuit breaker may change in dimension through stress, temperature, and wear, their angular relationships remain stable. Thus, the operating characteristics of circuit breakers in accordance with the invention exhibit an inherent stability despite variations in temperature and mechanical stress over the life of the breaker.

While there has been shown and described what is considered a preferred embodiment of the present invention, it will be obvious to those skilled in the art that various changes and modifications may be made therein without departing from the invention as defined by the appended claims.

What is claimed is:

1. A circuit breaker comprising a housing of insulating material;

a fixed contact mounted in said housing;

a contact carrier with a movable contact thereon;

operating means for manually moving said contact carrier to selectively move said movable contact between a closed position and an open position with respect to said fixed contact;

a trip arm pivotally mounted in said housing and movable from a set position to a tripped position;

a load terminal;

a thermally responsive latching member connected in circuit between said load terminal and said movable contact, said thermally responsive latching member having one end and having another end;

the one end of said thermally responsive latching member being pivotally mounted in said housing;

biasing means bearing against the other end of said thermally responsive latching member and urging the thermally responsive latching member toward said trip arm;

said thermally responsive latching member having a latching surface intermediate said one end and said other end thereof engaging said trip arm and maintaining said trip arm in the set position;

said thermally responsive latching member bending in response to a predetermined current condition to move the latching surface intermediate said one end and said other end of the thermally responsive latching member and disengage said latching surface from said trip arm releasing said trip arm for movement to the tripped position;

movement of the trip arm to the tripped position causing said contacts to open;

wherein said thermally responsive latching member includes an elongated thermally responsive element having one end and having another end;

the one end of said elongated thermally responsive element being pivotally mounted in said housing;

an armature element having an arm disposed generally parallel to the elongated thermally responsive element, said arm having one end and having another end, means adjacent to the one end of said arm for constraining the other end of the elongated thermally responsive element, and means adjacent to the other end of said arm for constraining said other end of the arm with respect to the central portion of the elongated thermally responsive element;

said latching surface of said thermally responsive latching member being located in said arm intermediate the one end and the other end thereof;

and wherein said biasing means bears against the armature element urging the armature element toward said trip arm.

2. A circuit breaker comprising a housing of insulating material;

a fixed contact mounted in said housing;

a contact carrier with a movable contact thereon;

operating means for manually moving said contact carrier to selectively move said movable contact between a closed position and an open position with respect to said fixed contact;

a trip arm pivotally mounted in said housing and movable from a set positon to a tripped position;

a load terminal;

a thermally responsive latching member connected in circuit between said load terminal and said movable contact, said thermally responsive latching member having one end and having another end;

the one end of said thermally responsive latching member being pivotally mounted in said housing;

biasing means bearing against the other end of said thermally responsive latching member and urging the thermally responsive latching member toward said trip arm;

said thermally responsive latching member having a latching surface intermediate said one end and said other end thereof engaging said trip arm and maintaining said trip arm in the set position;

said thermallly responsive latching member bending in response to a predetermined current condition to move the latching surface intermediate said one end and said other end of the thermally responsive latching member and disengage said latching surface from said trip arm releasing said trip arm for movement to the tripped position;

movement of the trip arm to the tripped position causing said contacts to open;

wherein said thermally responsive latching member includes an elongated thermally responsive element having one end and having another end;

the one end of said elongated thermally responsive element being pivotally mounted in said housing;

an armature element having a first arm disposed generally parallel to the elongated thermally responsive element, said first arm having one end and having another end, a second arm contiguous the first arm at the one end thereof and having a bend therein for positioning the other end of the elongated thermally responsive element, and a hook portion contiguous the other end of the first arm entrapping the central portion of the elongated thermally responsive element;

said latching surface of said thermally responsive latching member being located in said first arm intermediate the one end and the other end thereof;

and wherein said biasing means bears against a portion of said second arm of the armature element urging the armature element toward said trip arm with said other end of the thermally responsive element positioned in the bend of the second arm.

3. A circuit breaker in accordance with claim 2 wherein said first arm of the armature element has an aperture therein, the edge of said aperture toward said hook portion forming said latching surface of the thermally responsive latching member, and a portion of the surface of the first arm of the armature element adjacent to the aperture toward said one end thereof forming a bearing surface;

said trip arm includes a projection at one end extending into said aperture in the first arm of the armature element and having an edge surface generally normal to the first arm of the armature element forming a latching surface of the trip arm which engages the latching surface of the thermally responsive latching member when the trip arm is in the set position, and an edge surface at said one end adjacent to said projection forming a bearing surface which engages the bearing surface of the armature element when the trip arm is in the set position.

4. A circuit breaker in accordance with claim 3 wherein said elongated thermally responsive element bends in the direction away from said trip arm in response to said predetermined current condition with said one end pivoting in said housing and the other end pivoting in said bend in the second arm of the armature element;

movement of the central portion of the thermally responsive element during bending moving said hook portion of the armature element to pivot the armature element about the point of engagement of the bearing surfaces of the armature element and the trip arm removing the edge surface of said aperture which forms said latching surface from engagement with the edge surface of the projection of the trip arm which forms said latching surface of the trip arm thereby releasing the trip arm from the set position for movement to the tripped position.

5. A circuit breaker in accordance with claim 4 wherein said housing has a first recess for receiving said one end of the thermally responsive element so as to permit pivotal movement of the thermally responsive element;

said biasing means is a compression spring having one end and having another end;

said housing has a second recess for receiving the one end of the compression spring with the other end of the compression spring bearing against said portion of said second arm of the armature element and urging the armature element and thermally responsive element toward said trip arm and urging said one end of the thermally responsive element into said first recess in the housing.

6. A circuit breaker comprising a housing of insulating material;

a fixed contact mounted in said housing;

a manually movable handle mounted in said housing;

a contact carrier with a movable contact thereon and pivotally engaging said handle at a pivot point;

a trip arm pivotally mounted in said housing;

an overcenter spring connected between said contact carrier and said trip arm urging said contact carrier against said handle;

said handle, contact carrier, and overcenter spring forming an overcenter arrangement for closing said contacts when the spring is on one side of said pivot point and for opening said contacts when the spring is on the other side of said pivot point;

a load terminal mounted in said housing;

a thermally responsive latching member connected in circuit between said load terminal and said movable contact, said thermally responsive latching member having one end and having another end;

the one end of said thermally responsive latching member being pivotally mounted in said housing;

biasing means bearing against the other end of said thermally responsive latching member and urging the thermally responsive latching member toward said trip arm;

said thermally responsive latching member having a latching surface intermediate said one end and said other end thereof engaging said trip arm and maintaining said trip arm in a set position, with said overcenter spring urging said trip arm toward a tripped position;

said thermally responsive latching member bending in response to a predetermined current condition to move the latching surface intermediate said one end and said other end of the thermally responsive latching member and disengage said latching surface from said trip arm releasing said trip arm for movement to the tripped position;

movement of the trip arm to the tripped position moving overcenter spring to the other side of said pivot point causing said contacts to open;

wherein said thermally responsive latching member includes an elongated thermally responsive element having one end and having another end;

the one end of said elongated thermally responsive element being pivotally mounted in said housing;

an armature element having an arm disposed generally parallel to the elongated thermally responsive element, said arm having one end and having another end, means adjacent to the one end of said arm for constraining the other end of the elongated thermally responsive element, and means adjacent to the other end of said arm for constraining said other end of the arm with respect to the central portion of the elongated thermally responsive element;

said latching surface of said thermally responsive latching member being located in said arm intermediate the one end and the other end thereof;

and wherein said biasing means bears against the armature element urging the armature element toward said trip arm.

7. A circuit breaker comprising a housing of insulating material;

a fixed contact mounted in said housing;

a manually movable handle mounted in said housing;

a contact carrier with a movable contact thereon and pivotally engaging said handle at a pivot point;

a trip arm pivotally mounted in said housing;

an overcenter spring connected between said contact carrier and said trip arm urging said contact carrier against said handle;

said handle, contact carrier, and overcenter spring forming an overcenter arrangement for closing said contacts when the spring is on one side of said pivot point and for opening said contacts when the spring is on the other side of said pivot point;

a load terminal mounted in said housing;

a thermally responsive latching member connected in circuit between said load terminal and said movable contact, said thermally responsive latching member having one end and having another end;

the one end of said thermally responsive latching member being pivotally mounted in said housing;

biasing means bearing against the other end of said thermally responsive latching member and urging the thermally responsive latching member toward said trip arm;

said thermally responsive latching member having a latching surface intermediate said one end and said other end thereof engaging said trip arm and maintaining said trip arm in a set position, with said overcenter spring urging said trip arm toward a tripped position;

said thermally responsive latching member bending in response to a predetermined current condition to move the latching surface intermediate said one end and said other end of the thermally responsive latching member and disengage said latching surface from said trip arm releasing said trip arm for movement to the tripped position;

movement of the trip arm to the tripped position moving the overcenter spring to the other side of said pivot point causing said contacts to open;

wherein said thermally responsive latching member includes an elongated thermally responsive element having one end and having another end;

the one end of said elongated thermally responsive element being pivotally mounted in said housing;

an armature element having a first arm disposed generally parallel to the elongated thermally responsive element, said first arm having one end and having another end, a second arm contiguous the first arm at the one end thereof and having a bend therein for positioning the other end of the elongated thermally responsive element, and a hook portion contiguous the other end of the first arm entrapping the central portion of the elongated thermally responsive element;

said latching surface of said thermally responsive latching member being located in said first arm intermediate the one end and the other end thereof;

and wherein said biasing means bears against a portion of said second arm of the armature element urging the armature element toward said trip arm with said other end of the thermally responsive element positioned in the bend of the second arm.

8. A circuit breaker in accordance with claim 7 wherein said first arm of the armature element has an aperture therein, the edge of said aperture toward said hook portion forming said latching surface of the thermally responsive latching member, and a portion of the surface of the first arm of the armature element adjacent to the aperture toward said one end thereof forming a bearing surface;

said trip arm includes a projection at one end extending into said aperture in the first arm of the armature element and having an edge surface generally normal to the first arm of the armature element forming a latching surface of the trip arm which is urged against the latching surface of the thermally responsive latching member by said overcenter spring when the trip arm is in the set position, and an edge surface at said one end adjacent to said projection forming a bearing surface;

said bearing surface of the armature element being urged against said bearing surface of the trip arm by said overcenter spring when the trip arm is in the set position.

9. A circuit breaker in accordance with claim 8 wherein said elongated thermally responsive element bends in the direction away from said trip arm in response to said predetermined current condition with said one end pivoting in said housing and the other end pivoting in said bend in the second arm of the armature element;

movement of the central portion of the thermally responsive element during bending moving said hook portion of the armature element to pivot the armature element about the point of engagement of the bearing surfaces of the armature element and the trip arm removing the edge surface of said aperture which forms said latching surface from engagement with the edge surface of the projection of the trip arm which forms said latching surface of the trip arm thereby releasing the trip arm from the set position for movement to the tripped position.

10. A circuit breaker in accordance with claim 9 wherein said housing has a first recess for receiving the said one end of the thermally responsive element so as to permit pivotal movement of the thermally responsive element;

said biasing means is a compression spring having one end and having another end;

said housing has a second recess for receiving the one end of the compression spring with the other end of the compression spring bearing against said portion of said second arm of the armature element and urging the armature element and thermally responsive element toward said trip arm and urging said one end of the thermally responsive element into said first recess in the housing.

11. A circuit breaker in accordance with claim 9 wherein said armature element is of a magnetic material;

said first arm of the armature element being attracted toward said thermally responsive element in response to heavy current flow through the thermally responsive element to pivot the armature element about the one end of the thermally responsive element removing the edge surface of said aperture which forms said latching surface from engagement with the edge surface of the projection of the trip arm which forms said latching surface of the trip arm thereby releasing the trip arm from the set position for movement to the tripped position.

12. A circuit breaker in accordance with claim 9 wherein said trip arm has a notch therein adjacent to said projection for permitting deforming of said one end of said trip arm to adjust the position of said edge surface which forms said bearing surface of the trip arm.

* * * * *